United States Patent [19]

Atsumi et al.

[11] 4,427,856

[45] Jan. 24, 1984

[54] MECHANICAL SNAP SWITCH HAVING A MECHANISM FOR SEPARATING FUSED CONTACTS

[75] Inventors: Haruo Atsumi, Otsu; Haruyuki Koizumi, Kyoto, both of Japan

[73] Assignee: Omron Tateisi Elecronics Co., Kyoto, Japan

[21] Appl. No.: 325,666

[22] Filed: Nov. 30, 1981

[30] Foreign Application Priority Data

Dec. 9, 1980 [JP] Japan ..... 55-174431

[51] Int. Cl.[3] ..... H01H 15/18

[52] U.S. Cl. ..... 200/76; 200/153 LA; 200/67 PK

[58] Field of Search ..... 200/76, 77, 73, 67 PK, 200/153 LA, 330, DIG. 42

[56] References Cited

U.S. PATENT DOCUMENTS

| | | | |
|---|---|---|---|
| 3,895,205 | 7/1975 | Tharp | 200/153 LA X |
| 3,912,894 | 10/1975 | Mullen et al. | 200/153 LA |
| 3,967,081 | 6/1976 | Portmann et al. | 206/67 PK |
| 4,216,358 | 8/1980 | Brozille | 200/76 X |

FOREIGN PATENT DOCUMENTS

| | | | |
|---|---|---|---|
| 1935225 | 2/1971 | Fed. Rep. of Germany | 200/76 |

*Primary Examiner*—John W. Shepperd
*Assistant Examiner*—Renee S. Kidorf
*Attorney, Agent, or Firm*—Wegner & Bretschneider

[57] ABSTRACT

A mechanical switch comprises a pusher rod, a movable member movable from one position to another position in response to the depression of the pusher rod, a movable contact carrier normally held in position to connect a pair of contact elements on respective terminal members to each other therethrough so long as the pusher rod has not yet been depressed, and a return biasing spring for urging the movable member to the one position. The contact carrier is, as the movable member approaches the another position in response to the movement of the pusher rod, snapped to move from the position in which the contact elements are connected to each other to a different position to disconnect or open the circuit between the terminal members. The pusher rod has an abutment defined therein to forcibly separate the contact elements from the contact carrier in the event that the contact elements have been fused to the contact carrier.

7 Claims, 9 Drawing Figures

MECHANICAL SNAP SWITCH HAVING A MECHANISM FOR SEPARATING FUSED CONTACTS

The present invention generally relates to a mechanical switch and, more particularly, to a component switch built in a limit switch assembly generally used as a position detector in a machine tool or the like. Specifically, the present invention pertains to a mechanical switch of a type incorporating therein an override mechanism for forcibly separating a movable contact member from one switching position to another switching position.

There has long been known a mechanical switch incorporating therein an override mechanism for forcibly separating a movable contact member or bridge from one switching position, in which a pair of space stationary contacts are connected to each other through the movable bridge to complete a circuit, to another switching position in which the stationary contacts are isolated from each other to open the circuit. An example of this known mechanical switch is schematically illustrated in FIG. 1 of the accompanying drawings in the form of a normally closed switch and, therefore, reference will now be made thereto for the discussion of the prior art.

The prior art mechanical switch shown in FIG. 1 comprises a pusher rod 1 made of electrically insulating material and carrying a movable switching member extending generally at right angles to the pusher rod 1. The movable switching member is made of electroconductive elastic material, such as a leaf spring, and is constituted by a unitary structure of a pair of elastic fingers 2 and an elastic bridge 4, said elastic fingers 2 being so separated at a position intermediate of the length of the movable switching member that the opposed ends of the respective fingers 2 can be engaged to the pusher rod 1 from opposite directions transversely of the pusher rod 1. The movable switching member has a pair of contacts 6 secured respectively to the opposite ends thereof for the selective engagement with a first pair of stationary contacts 7 or a second pair of stationary contacts 8. In the construction so far described, while the movable switching member, more particularly the bridge 4, is normally held in a connecting position in which the first pair of the stationary contacts 7 are electrically connected to each other through the bridge 4 as shown in FIG. 1, application of an external pushing force to the pusher rod 1 in a direction shown by the arrow in FIG. 1 to move said pusher rod 1 from a projected position towards a depressed position causes the fingers 2, then upwardly warped or bowed against their own elasticity as shown, to be warped or bowed downwards with the consequence that the elastic bridge 4 is suddenly moved, i.e., snapped, from the connecting position to a disconnecting position in which the contacts 6 on the movable switching member are disengaged from the associated first stationary contacts 7 and are engaged to the associated second stationary contacts 8. In this example, the second stationary contacts 8 merely serve as stoppers and have no electrical connection whatsoever.

However, it has often occurred that, in the construction so far described, one or both of the contacts 6 on the movable switching member stick, by fusion, to the respective first stationary contact or contacts 7 against the force tending to cause the elastic bridge 4 in the connecting position to undergo a snap action so as to assume the disconnecting position, with the switch failing to operate, i.e., open the circuit properly at the desired time. The sticking phenomenon by fusion occurs, for example, when an overload current flows through the normally closed switch evolving heat energies effective to fuse some or all of the contacts 6 and 7.

It is the override mechanism that forces the movable switching member to move from the connecting position towards the disconnecting position with the contacts 6 separating away from the associated first stationary contacts 7. The override mechanism used in the normally closed switch shown in FIG. 1 generally comprises a pair of levers 9 supported by associated bearing pins 10 for pivotal movement between inoperative and operative positions and being cooperable with a pair of steps 3 defined in the pusher rod 1. The override mechanism is so designed and so positioned that, as the pusher rod 1 is moved downwards, as viewed in FIG. 1, towards the depressed position by the application of the external pushing force, respective ends **9*a* of the levers 9 remote from the movable switching member can slidingly ride over the associated steps 3 thereby pivoting from the inoperative position towards the operative position about the bearing pins 10 and that, upon arrival of the pusher rod 1 at the depressed position, the levers 9 assume the operative position with the other ends 9*b* thereof contacting the movable switching member to separate the contacts 6 away from the associated stationary contacts 7**.

In the mechanical switch of the construction shown in FIG. 1 and discussed above, the movement of the movable switching member by the snap action from the connecting position towards the disconnecting position is assisted by a shifting force transmitted thereto from the pivotable levers 9 so that the contacts 6 engaged to the respective stationary contacts 7 under the influence of a biasing force of the elastic bridge 4 can be forcibly separated from the respective stationary contacts 7.

However, the prior art mechanical switch has some disadvantages. By way of example, in view of the design wherein, irrespective of the occurrence of the sticking phenomenon, the contacts 6 on the movable switching member are always forced to separate away from the stationary contacts 7 each time the pusher rod 1 is depressed, i.e., moved to the depressed position, respective portions of the pusher rod 1 defining the steps 3 tend to be worn earlier than expected in sliding contact with the associated ends **9*a* of the pivotable levers 9. This means that there is such a possibility that, at the time the normally closed switch should open the circuit for, for example, safeguarding purpose, it will fail to do so unless an external pulling force is applied to the pusher rod 1 to move the latter from the depressed position towards the projected position. In other words, in the event that the steps 3 in the pusher rod 1** are excessively worn out, the normally closed switch of the type now under discussion loses an automatic and immediate self-opening capability.

In addition, the shifting force transmitted to the movable switching member from the pivotable levers 9 in the operative position for forcibly separating the contacts 6 from the associated stationary contacts 7 is constituted only by a tensile force and neither a bending force nor a shearing force act on the movable switching member. Therefore, where the contacts 6 and 7 are made of silver, the separation of the contacts 6 from the stationary contacts 7 requires the application of 1 to 5 kg of the shifting force. This leads to the requirement that the levers 9 must have a sufficient rigidity and/or the bearing pins 10 must be employed.

The present invention has been developed with a view to substantially eliminating the disadvantages and inconveniences inherent in the prior art mechanical switch and has for its essential object to provide an improved mechanical switch effective to perform an automatic and immediate self-switching capability only at the right time and in case of emergency.

Another important object of the present invention is to provide an improved mechanical switch of the type referred to above, which requires a relatively small force to move a movable contact member from one switching position to another switching position.

These and other objects and features of the present invention will become clearly understood from the following description taken in conjunction with preferred embodiments thereof with reference to the accompanying drawings, in which.

Figure 1:
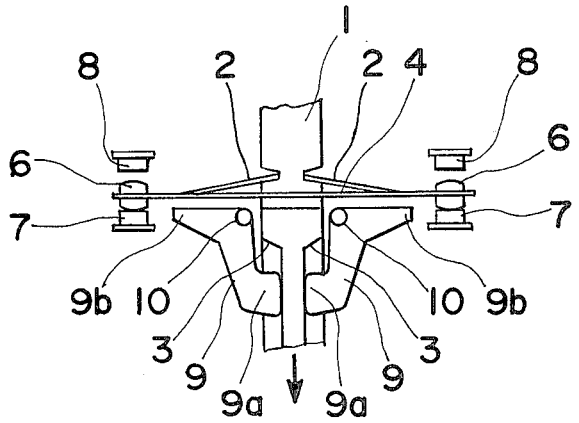
Fig. 1 Prior Art
FIG. 1 is a schematic sectional view of an essential portion of the prior art mechanical switch.

Before the description of the present invention proceeds, it is to be noted that like parts are designated by like reference numerals throughout the accompanying drawings. It is also to be noted that, for the sake of brevity, the description will be made in connection with a normally closed switch, but that the switch embodying the pesent invention should not be limited thereto and can be used in any way depending on the user's desire and/or the particular application.

Figure 2:
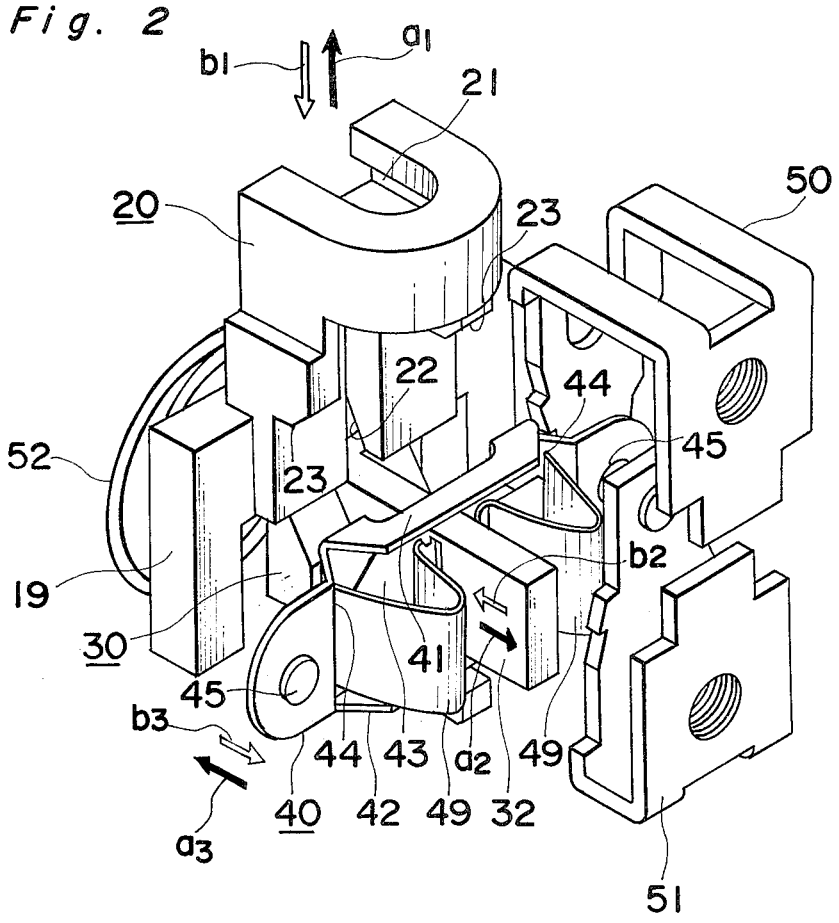
FIG. 2 is a perspective view of an essential portion of the mechanical switch according to a first preferred embodiment of the present invention.

Referring now to FIGS. 2 to 6, a mechanical switch embodying the present invention generally comprises a push button 20, a generally T-shaped movable member 30 made of electrically insulating material, a movable contact carrier 40 made of electroconductive material, a first pair of spaced terminal members 50 (the second side of the terminal members 50, not shown, is disposed on the left side of movable contact carrier 40, as viewed in FIG. 2, and corresponding to contact 45) having respective stationary contacts which are rigidly carried thereby, a second pair of spaced terminal members 51 (the second side of terminal members 51, not shown, is also disposed on the left side of movable contact carrier 40, as viewed in FIG. 2, and corresponding to contact 45) having respective stationary contacts which are rigidly carried thereby, and a return biasing spring 52. So far illustrated, the switch shown is a double pole double throw switch in which either the first pair of the terminal members 50 or the second pair of the terminal members 51 are selectively connected to each other through the movable contact carrier 40 depending on the position of the movable contact carrier 40. However, for the purpose of the nature of the mechanical switch, i.e., the safety switch, the switch so far shown is of a type wherein the first pair of the spaced terminal members 50 are normally connected to each other to complete an electrical circuit with the movable contact carrier 40 held in a first position whereas the second pair of the spaced terminal members 51 may be used either as stoppers as is the case with the second pair of the stationary contacts in the prior art switch described with reference to FIG. 1, or as circuit elements to be connected to each other through the movable contact carrier 40 when the latter is moved from the first position to a second position.

As best shown in FIG. 2, the push button 20 is supported, guided by a guide 19 forming a part of a switch casing (not shown), for movement between projected and depressed positions in a direction lengthwise thereof. This push button 20 has its upper end portion adapted to be engaged with an actuating plunger (not shown) and also its lower end portion formed with first and second opposed slopes 22 and 23 which are respectively operatively associated with the movable member 30 and the contact carrier 40 as will be described later. As will become clear from the subsequent description, the push button 20 is normally held in the projected position by the action of a biasing force of the return biasing spring 52.

The movable member 30 is guided in any suitable manner in the switch casing (not shown) for movement between first and second positions in a direction generally at right angles to the direction of movement of the push button 20 and is normally biased to the first position in a direction shown by the arrow $a_2$ by the return biasing spring 52. So far illustrated, the biasing spring 52 is a compression spring spirally wound to assume a substantially conical shape, but may be any other suitable spring, including a tension spring, if it serves to bias the movable member 30 to the first position.

The movable member 30 is formed at 31 with mating slopes slidingly engageable with the slopes 22 in the push button 20 so that, as the push button 20 is moved from the projected position towards the depressed position, the movable member 30 can be moved from the first position towards the second position against the return biasing spring 52 in a direction shown by the arrow $b_2$.

The movable contact carrier 40 is in the form of a generally rectangular metal strip and has a rectangular opening 43 defined in a substantially intermediate portion thereof, its opposite ends carrying movable contacts 45 which are rigidly carried thereby. The movable contact carrier 40 is stepped at 44 to provide a pair of opposite shoulders each at the boundary between the intermediate portion of the member 40 and the adjacent end of the same member 40, the function of said shoulder 44 being described later. In addition, a pair of opposite lateral edge portions 41 and 42 one on each side of the longitudinal axis of said movable contact carrier 40 are bent to protrude in a direction opposite to the slopes 23 in the push button 20 for the purpose as will become clear from the subsequent description.

The movable contact carrier 40 of the construction described above is housed within the switch casing (not shown) and is loosely mounted on the movable member 30 extending through the rectangular opening 43. This movable contact carrier 40 can be snapped, i.e., be movable by a snap action, between first and second positions in a direction parallel to the direction of movement of the movable member 30 and, for this purpose, a movable spring 49 which is in the form of a waved or V-shaped leaf spring so far shown, is positioned with its opposite ends engaged to the movable member 30 and the respective shoulder 44.

The first and second pairs of terminal members 50 and 51 are so positioned that the stationary contacts (not shown) on each pair of the terminal members 50 or 51 face the respective movable contact 45 on the contact carrier 40 from opposite directions.

In the construction described above, so long as the push button 20 is in the projected position with the movable member 30 consequently in the first position as biased by the return biasing spring 52, the contact carrier 40 is held in the first position with the terminal members 50 electrically connected to each other through the contact carrier 40. This condition is illustrated in FIG. 2. Starting from this condition, the mechanical switch embodying the present invention operates in the following manner.

Figure 3:
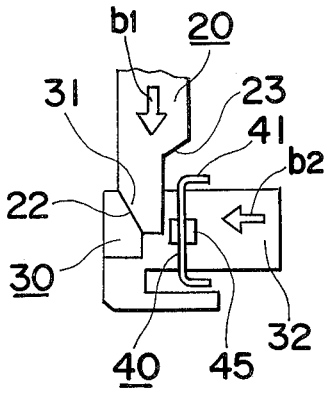
FIG. 3 is a schematic side view of the essential portion of the mechanical switch shown in FIG. 2.
Figure 4:
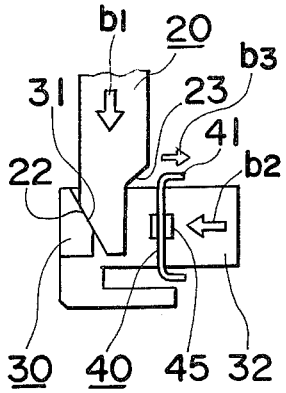
FIG. 4 is a schematic side view of the switch of FIG. 2.

Assuming that the push button 20 is moved from the projected position towards the depressed position by the application of an external pushing force thereto in a direction $b_1$, the first slopes 22 are brought to contact the mating slopes 31 as best shown in FIG. 3. The continued movement of the push button 20 towards the depressed position causes the movable member 30 to move from the first position towards the second position in the direction of the arrow $b_2$ with the slopes 22 held in sliding contact with the mating slopes 31. Unless the movable contacts 45 stick to the associated contacts on the terminal members 50, that is, if the sticking phenomenon has not yet occurred between the movable contacts on the contact carrier 40 and the stationary contacts on the terminal members 50, the contact carrier 40 can be snapped in a direction $b_3$, as shown in FIG. 4, by the action of the springs 49 from the first position to the second position to disconnect the terminal members 50 fom each other shortly before or simultaneously with the arrival of the push button 20 at the depressed position and, hence, the arrival of the movable member 30 at the second position.

However, should the contacts on the contact carrier 40 be sticking to the respective contacts on the terminal members 50 with the contact carrier 40 hesitating to move from the first position towards the second position, the second slopes 23 in the push button 20 being then depressed slidingly contact the bent area between the lateral edge 41 and the substantially intermediate portion of the contact carrier 40, thereby applying a force necessary to forcibly separate the contacts on the contact carrier 40 from the contacts on the terminal members 50. By the action of this force transmitted from the push button 20 to the contact carrier 40, the contacts on the contact carrier 40 can be forcibly separated from the contacts on the terminal members 50 to allow the contact carrier 40 to be immediately snapped towards the second position as shown in FIG. 6.

Figure 5:
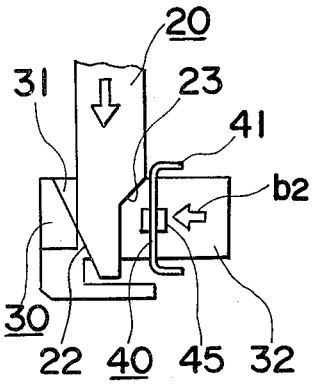
FIG. 5 is a schematic side view of the switch of FIG. 2.

It is to be noted that, although the second slopes in the push button 20 are likely to contact the bent area between the lateral edge 41 and the substantially intermediate portion of the contact carrier 40 each time the push button 20 is depressed, a substantial and forceful contact of the second slopes 23 to the bent area between the lateral edge 41 and the substantially intermediate portion of the contact carrier 40 will not take place since, unless the sticking phenomenon occurs, the contact carrier 40 has already been snapped to the second position as shown in FIG. 5.

Figure 6:
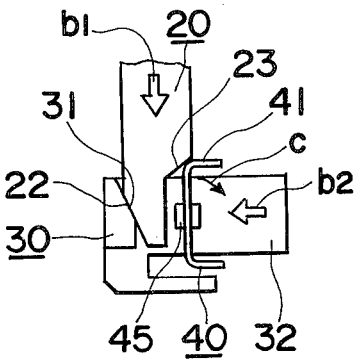
FIG. 6 is a schematic side view of the switch of FIG. 2 (FIGS. 3 to 6 when considered together form a sequential view of the operation of the switch of FIG. 2)

From the foregoing, because of the contact of the second slopes 23 with the bent area between the lateral edge 41 and the substantially intermediate portion of the contact carrier 40, not only can the contact carrier 40 receive both of tensile and shearing forces, but also it can receive a bending force, acting thereon in a direction shown by the arrow c in FIG. 6 and, therefore, the contacts on the contact carrier 40 sticking to the respective contacts on the terminal members 50 can be forcibly separated therefrom with a relatively small quantity of separating force.

Figure 7:
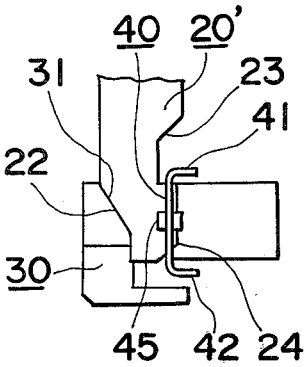
FIG. 7 is a view similar to FIG. 6, showing a second embodiment of the present invention.
Figure 8:
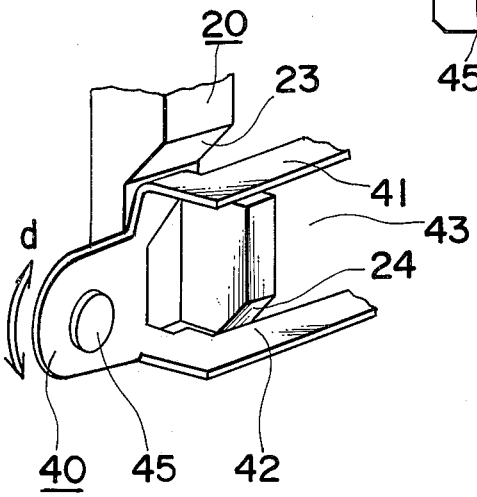
FIG. 8 is a perspective view of a movable contact member used in the mechanical switch according to the second embodiment of the present invention.

Shown in FIGS. 7 and 8 are another preferred embodiment of the present invention. In this embodiment of FIGS. 7 and 8, in addition to the second slopes 23, additional or third slopes 24 are defined in the push button 20' in spaced and opposite relation to the second slopes 23 for engagement with a lip region of the lateral edge 42 adjacent the opening 43, only one of said third slopes 24 being shown in FIG. 8. Except for the difference in location where the push button 20' being depressed contacts the contact carrier 40, the third slopes 24 function in a manner substantially similar to the second slopes 23. The second and third slopes 23 and 24 are preferably so spaced that the contact of the second slopes 23 with the bent area between the lateral edge 41 and the substantilly intermediate portion of the contact carrier 40 can be followed by the contact of the third slope 24 with the lip region of the lateral edge 42 adjacent the opening 43 during the movement of the push button 20' towards the depressed position. This is because, if the space between the second and third slopes 23 and 24 is such as to permit both of these contacts to occur simultaneously, the contact carrier 40 will no longer receive such a bending force as shown by the arrow c in FIG. 6 and, therefore, a relatively large forced separating force will be required to separate the contacts on the contact carrier 40 from the contacts on the terminal members 50 as compared with that in the foregoing embodiment.

The embodiment shown in FIGS. 7 and 8 is particularly advantageous where the space between the contacts on the terminal members 50 and the contacts on the terminal members 51 is relatively small and where any possible tilt of the contact carrier 40 due to the bending force acting in the direction shown by the arrow c in FIG. 6 is desired to be avoided to prevent the contact or contacts on the terminal member or members 50 from being electrically connected to the associated contact or contacts on the terminal member or members 51 through the contact carrier 40.

The mechanical switch according to any one of the foregoing embodiments of FIGS. 2 to 6 and FIGS. 7 and 8 functions satisfactorily and effectively. However, although it seldom happens, any possible breakage or separation of one or both of the springs 49 from the definite position would result in a loss of support for the contact carrier 40 and, therefore, in that the second slopes 23 in case of the embodiment of FIGS. 2 to 6, or both of the second and third slopes 23 and 24 in case of the embodiment of FIGS. 7 and 8, will no longer correctly act on the contact carrier 40 during the movement of the push button 20' towards the depressed position. Specifically, should one or both of the springs 49 be broken and/or separated from their definite positions, the contact carrier 40 will become loose, possibly jolting in a direction shown by the arrow d relative to the movable member 30 to such an extent that, even though the push button 20' has been moved to the depressed position, the second slopes 23 will not contact the bent area between the lateral edge 41 and the substantially intermediate portion of the contact carrier 40 in the case of the embodiment shown in FIGS. 2 to 6, or both of the second slopes and the third slopes 24 will not respectively contact that bent area and the lip region of the lateral edge 42 adjacent the opening 43 in the case of the embodiment shown in FIGS. 7 and 8.

Figure 9:
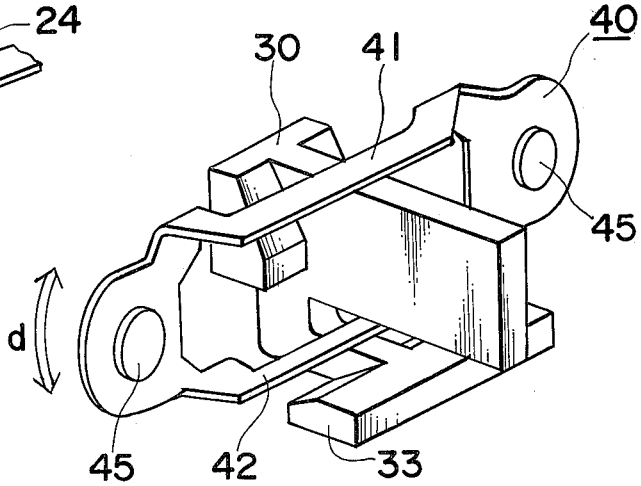
FIG. 9 is a perspective view of the movable contact member employed in the mechanical switch according to a third embodiment of the present invention.

This undesirable possibility can advantageously be avoided by providing a support arm 33 connected rigidly to, or otherwise formed integrally with the movable member 30 so as to extend underneath the lateral edge 42 in the contact carrier 40 so that the latter can be supported from below, as shown in FIG. 9.

From the foregoing, it has now become clear that, only when the sticking phenomenon has occurred, the push button 20' contacts the contact carrier 40 in the specific manner as hereinbefore described to forcibly separate the contacts on the contact carrier 40 from the associated contacts on the terminal members 50. In other words, so long as no sticking phenomenon occur, no contact between the push button 20' and the contact carrier take place and, therefore, any possible frictional wear of a portion or portions of the push button 20' defining the second slopes 23 or both of the second and third slopes 23 and 24 can advantageously be minimized. In view of this, the mechanical switch embodying the present invention can be reliably used to open the circuit between the terminal members 50 at the right time, for example, in case of emergency, with no fault.

Moreover, because of all of the tensile, bending and shearing forces acting on the contact carrier 40 when forcibly separating the contacts on the contact carrier 40 from the associated contacts on the terminal members 50, the minimized separating force is sufficient to achieve this.

Although the present invention has fully been described in connection with the preferred embodiments thereof with reference to the accompanying drawings, it is to be noted that various changes and modifications are apparent to those skilled in the art. By way of example, the number of the slopes 22, 23, 24 or 31 may not be two such as shown and described, but may be one. Such changes and modifications are, unless they depart from the true spirit and scope of the present invention, to be construed as included therein.

What is claimed is:

1. A mechanical switch, comprising:

a push button member;

a movable member movable from a first position to a second position in response to the depression of the push button member;

a movable contact carrier normally held in position to connect a pair of contact elements on respective terminal members to each other therethrough so long as the push button member has not yet been depressed;

and a return biasing spring for urging the movable member to the first position;

said mechanical switch operating such that as the movable member approaches said second position in response to the movement of the push button member, said contact carrier is snapped to move from the position to which the contact elements are connected to each oher to a different position to disconnnect or open the circuit between the terminal member; and said push button member having a sloped abutment defined therein and engageable with said movable contact carrier when said push button member is depressed to forcibly separate the contact elements from the contact carrier in a direction perpendicular to the direction of movement of said push button member in the event that the contact elements have been fused to the contact carrier.

2. A mechanical switch comprising, in combination:

a push button member supported for movement between projected and depressed positions;

a movable member made of electrically insulating material and supported for movement between first and second positions in a direction perpendicular to the direction of movement of the push button member;

a biasing means for biasing the movable member to the first position;

means defined in said push button member and said movable member for causing the movable member to move from the first position towards the second position against the biasing means in response to the movement of the push button member from the projected position towards the depressed position;

a generally elongated contact carrier means supported for movement between operative and inoperative positions in a direction generally parallel to the direction of movement of the movable member, said carrier means being normally held in the operative position;

a pair of spaced terminal members defining the operative position for the carrier means, at least one of said terminal members having a stationary contact element;

a snap acting spring means interposed between the movable member and the carrier means such that, as the movable member being moved from the first position towards the second position in response to the movement of the push button member form the projected position towards the depressed position approaches the second position, the carrier means can be snapped to move from the operative position towards the inoperative position to open the circuit between terminal members; and a sloped abutment defined in the push button member and engageable with a portion of the carrier means, when the push button member is moved to the depressed position, for forcibly separating the contact elements from the carrier means in the event that the contact elements have been fused to the carrier means.

3. A mechanical switch as claimed in claim 2, wherein said pair of spaced terminal members having respective stationary contact elements and defining the operative position for the carrier means are electrically connected to each other through the carrier means so long as said carrier means is in the operative position.

4. A mechanical switch as claimed in any one of claims 1, 2, or 3, further comprising a support member extending beneath the movable member in spaced relation thereto for the support of the carrier means from below.

5. A mechanical switch comprising, in combination:

a push button member supported for movement between projected and depressed positions;

a movable member made of electrically insulating material and supported for movement between first and second positions in a direction perpendicular to the direction of movement of the push button member;

a biasing means for biasing the movable member to the first position;

means defined in said push button member and said movable member for causing the movable member to move from the first position towards the second position against the biasing means in response to the movement of the push button member from the projected position towards the depressed position;

a generally elongated contact carrier means supported for movement between operative and inoperative positions in a direction generally parallel to the direction of movement of the movable member, said carrier means being normally held in the operative position;

a pair of spaced terminal members defining the operative position for the carrier means, at least one of said terminal members having a stationary contact element;

a snap acting spring means interposed between the movable member and the carrier means such that, as the movable member being moved from the first position towards the second position in response to the movement of the push button member from the projected position towards the depressed position approaches the second position, the carrier means can be snapped to move from the operative position towards the inoperative position to open the circuit between the terminal members;

a sloped abutment defined in the push button member and engageable with a portion of the carrier means, when the push button member is moved to the depressed position, for forcibly separating the contact elements from the carrier means in the event that the contact elements have been fused to the carrier means; and said switch also having an additional sloped abutment defined in the push button member in spaced and opposite relation to said sloped abutment, said additional sloped abutment being engageable with another portion of the carrier means opposite to said portion of the carrier means for forcibly separating the contact elements from the carrier means in the event that the contact elements have been fused to the carrier means.

6. A mechanical switch as claimed in claim 5, wherein said sloped abutment and said additional sloped abutment are so spaced that the engagement of the additional sloped abutment with said other portion of the carrier means takes place subsequent to the engagement of the sloped abutment with the portion of the carrier means.

7. A mechanical switch as claimed in claim 5, further comprising a support member extending beneath the movable member in spaced relation thereto for the support of the carrier means from below.

* * * * *